US006681598B2

(12) United States Patent
Cheng

(10) Patent No.: US 6,681,598 B2
(45) Date of Patent: Jan. 27, 2004

(54) STRINGLESS BEAD CONNECTOR

(76) Inventor: Howard S. Cheng, 2821 S. Quinn St., Chicago, IL (US) 60608

( * ) Notice: Subject to any disclaimer, the term of this patent is extended or adjusted under 35 U.S.C. 154(b) by 4 days.

(21) Appl. No.: 10/053,965

(22) Filed: Jan. 22, 2002

(65) Prior Publication Data

US 2003/0136148 A1 Jul. 24, 2003

(51) Int. Cl.[7] ..... A44C 5/00

(52) U.S. Cl. ..... 63/3.1; 63/3; 63/26; 63/38; 24/574.1; 24/DIG. 31

(58) Field of Search ..... 63/3, 3.1, 4, 26, 63/29.1, 38, 39; 24/574.1, 581.1, DIG. 31, DIG. 35

(56) References Cited

U.S. PATENT DOCUMENTS 951,708 A * 3/1910 Strasburg et al. ..... 24/574.1
1,199,690 A * 9/1916 Gillian ..... 24/581.1
1,859,819 A * 5/1932 Duerr ..... 59/80
2,013,283 A * 9/1935 Merrill ..... 403/314
2,263,340 A * 11/1941 Kraemer ..... 59/80
2,763,981 A * 9/1956 Blumstein ..... 59/82
3,357,204 A * 12/1967 Davis ..... 63/39
3,386,240 A * 6/1968 Blumstein ..... 59/78
4,246,679 A * 1/1981 Monett ..... 24/587.11
4,562,704 A * 1/1986 Benedek et al. ..... 63/3.1
6,357,261 B1 * 3/2002 Cheng ..... 63/3.1
6,508,080 B1 * 1/2003 Ninomiya ..... 63/3.1

* cited by examiner

*Primary Examiner*—Andrea Chop
(74) *Attorney, Agent, or Firm*—Andrus, Sceales, Starke & Sawall

(57) ABSTRACT

A stringless connector for a strand of beads includes a two-piece interlocking assembly, each piece provided with an eyelet for connection to eyelets of connectors for adjacent beads. The eyelet of one member defines a pair of legs that are inserted into one end of the bore in a bead, one of the legs having locking tooth projecting toward the other leg. The other member has a straight shank extending into the bore from its eyelet, the end of the shank provided with a second locking tooth which enters the slot between the legs of the first member, overrides the tooth thereon and interlocks therewith.

4 Claims, 2 Drawing Sheets

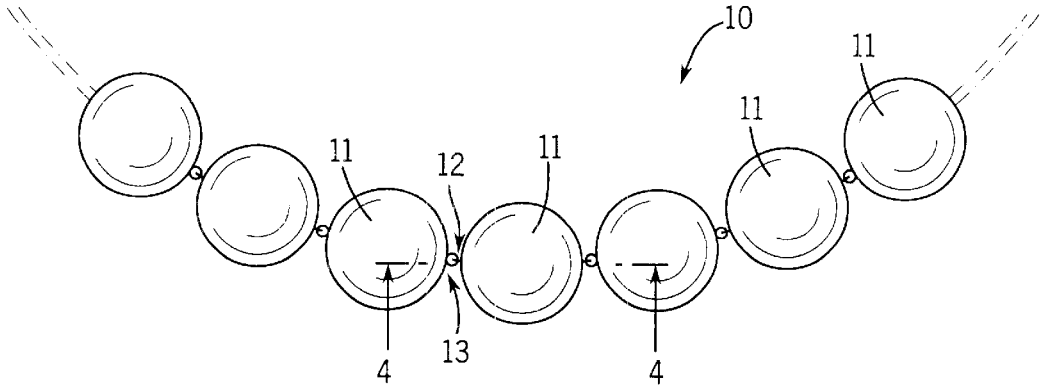
FIG. 1
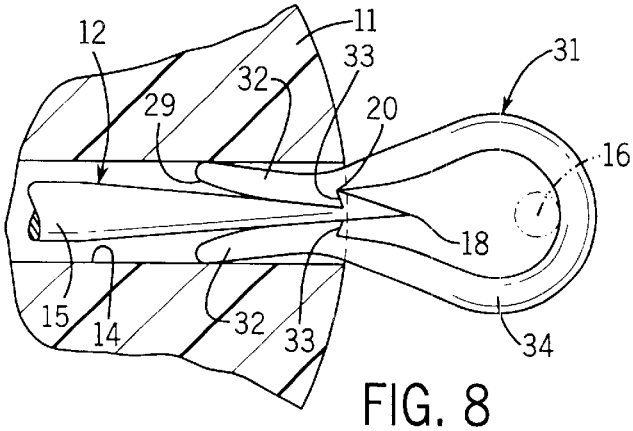
FIG. 8
FIG. 7
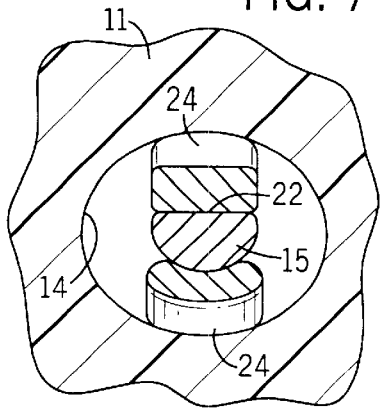
FIG. 3
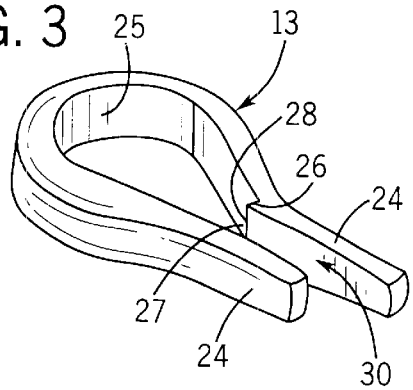
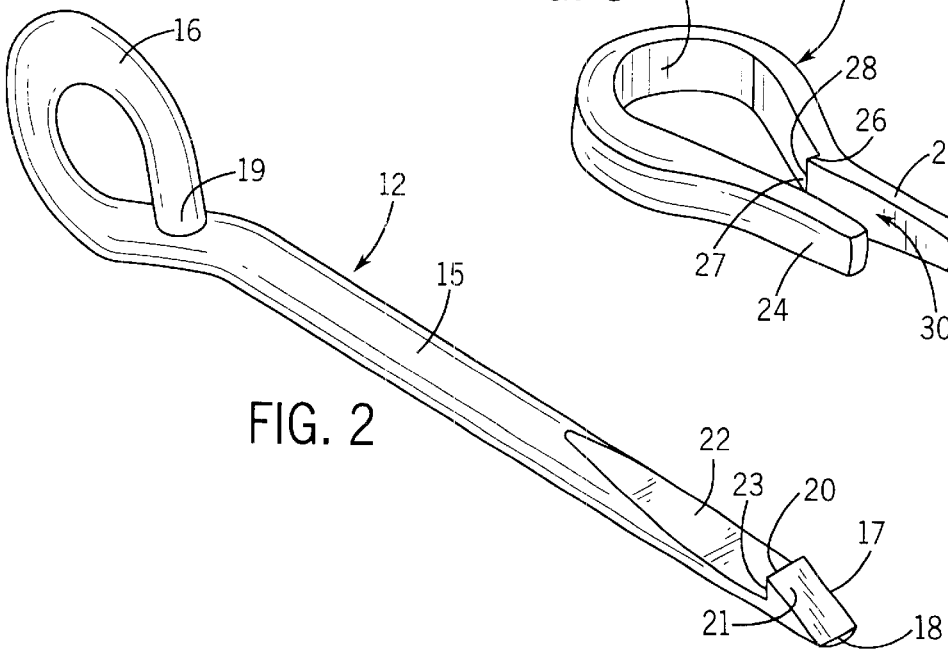
FIG. 2

STRINGLESS BEAD CONNECTOR

BACKGROUND OF THE INVENTION

The present invention pertains to a connector for stringing beads into a strand and, more particularly, to a connector for a strand of pearls or similar beads which does not require the use of a continuous string.

It is well known and very common to form a strand of beads, each of which has been through-bored, on a string to form a necklace, bracelet or the like. String material of braided silk is commonly used, but other flexible string materials have also been used. String-like materials may have to be replaced from time to time, and are subject to breakage that often results in the loss of beads. However, suitable substitutes for string materials have not been found. It is known in the art to utilize metal strand connectors that extend through the bores in a string of beads, are provided with end eyelets to connect with the eyelets of adjacent beads and form an interconnected strand. However, such connectors have been of complex construction, difficult to assemble, and/or result in a strand of beads that is much too stiff as compared, for example, to a string-like material that it is intended to replace.

SUMMARY OF THE INVENTION

The present invention is directed to a connector and related method for interconnecting through-bored beads to provide a strand without the use of a continuous string but in a manner that retains significant flexibility in the strand. The connector of the present invention, in its basic embodiment, comprises a loop member that is made from a first metal strand that is formed to define a pair of legs interconnected by a first eyelet. The legs define an attachment slot and are sized to fit in one end of the bore in the bead. At least one of the legs is provided with a first tooth that is positioned in the slot. A cooperating pin member is made from a second metal strand and is formed with a straight shank that is curled on one end to form a second eyelet. The shank is sized to fit into the other end of the bore and has formed on the other end a second tooth. The second tooth is adapted to override the first tooth of the loop member in response to insertion of the toothed end of the shank into the attachment slot to lock the members together in the bore.

In accordance with the corresponding method of the present invention, the method comprises the steps of (1) forming a loop member from a first metal strand having a pair of legs connected by a first eyelet, and providing one of said legs with a first tooth extending toward the other leg, (2) forming a pin member from a second metal strand having a straight shank that is curled on one end to form a second eyelet and provided on the other end with a second tooth, (3) inserting the legs of the loop member and the toothed end of the pin member shank into opposite ends of the through bore in a bead, and (4) causing the second tooth to pass between the legs and into locking engagement with the first tooth, leaving the first and second eyelets positioned outside and immediately adjacent the opposite ends of the bore. The method also includes, prior to the inserting step, the step of connecting the first eyelet of a second loop member to said second eyelet and connecting the second eyelet of a second pin member to said first eyelet, thereby providing connection for the next adjacent beads in the strand.

Preferably, the first tooth is formed to be positioned on the leg of the loop member adjacent the transition of the leg into the first eyelet. The first tooth on the leg of the loop member preferably defines a laterally extending locking edge, and the second tooth on the pin member similarly defines a laterally extending locking edge which overrides the locking edge of the first tooth in response to insertion of the pin member shank into the slot in the loop member. In an alternate embodiment, both legs of the loop member may be provided with opposed teeth, either one of which may be engaged by the second tooth on the pin member, depending on its rotational orientation upon insertion.

BRIEF DESCRIPTION OF THE DRAWINGS

FIG. 1 shows the general arrangement of a portion of a strand of beads interconnected with the connector and method of the present invention.

FIG. 2 is a greatly enlarged perspective view of the pin member of the connector.

FIG. 3 is a greatly enlarged perspective view of the loop member of the connector.

FIG. 7 is an enlarged sectional detail taken on line 7—7 of FIG. 4.

FIG. 8 is a sectional detail similar to FIG. 6 showing an alternate embodiment of the loop member.

DETAILED DESCRIPTION OF THE PREFERRED EMBODIMENT

Figure 4:
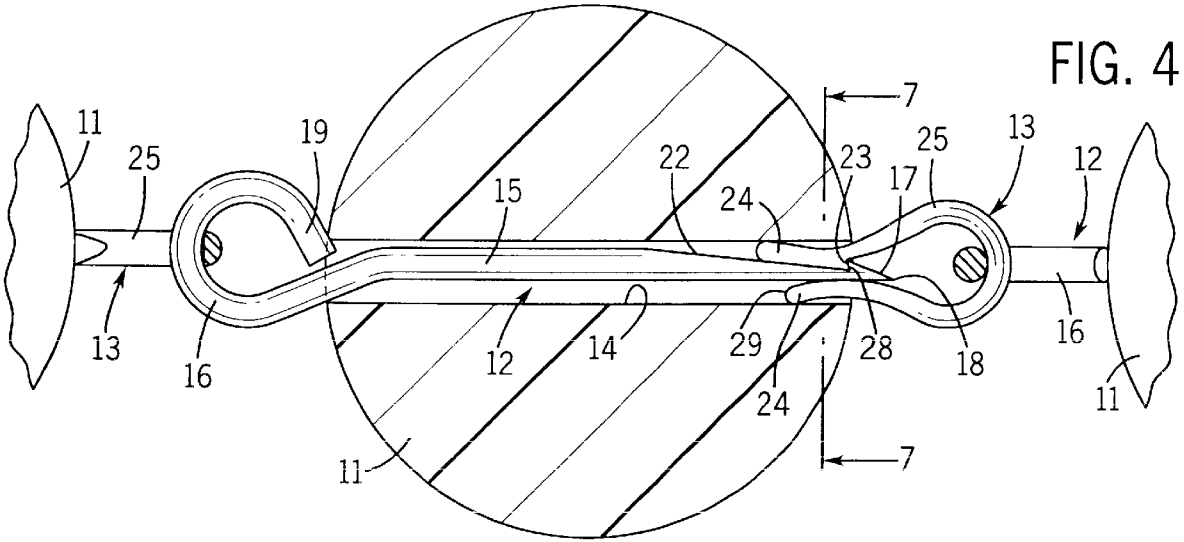
FIG. 4 is a side elevation of a sectioned through-bored bead showing the interconnection of the connector members as well as their connection to members for the next adjacent beads on the strand.

Referring first to FIGS. 1–3, the stringless connector for a strand 10 of beads 11 comprises a two-piece assembly that includes a pin member 12 (FIG. 2) and a loop member 13 (FIG. 3). The members 12 and 13 are adapted to be inserted into opposite ends of a through bore 14 in a bead 11 (see FIG. 5) where they engage and lock to one another. Both the pin member 12 and the loop member 13 are made from metal strands, preferably a metal that exhibits both malleability and some resilience, such as a gold alloy commonly used in the manufacture of jewelry.

As shown in FIG. 2, the pin member 12 includes a straight shank 15, one end of which is curled or bent back on itself to form an eyelet 16. The opposite end of the shank 15 is formed to define a locking tooth 17. The locking tooth has a laterally extending lead edge 18 and a laterally extending locking edge 20, between which edges is a generally flat ramp surface 21. A portion of the shank 15 immediately adjacent the tooth 17 is provided with a flat surface 22 that terminates at the tooth to define a locking surface 23 on the back side of the tooth 17.

Figure 6:
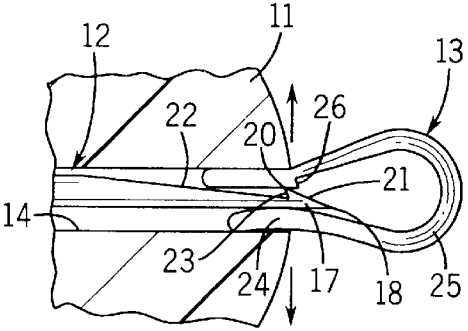
FIG. 6 is a detail showing movement of the end of the pin member into the legs of the loop member just prior to locking engagement.
Figure 5:
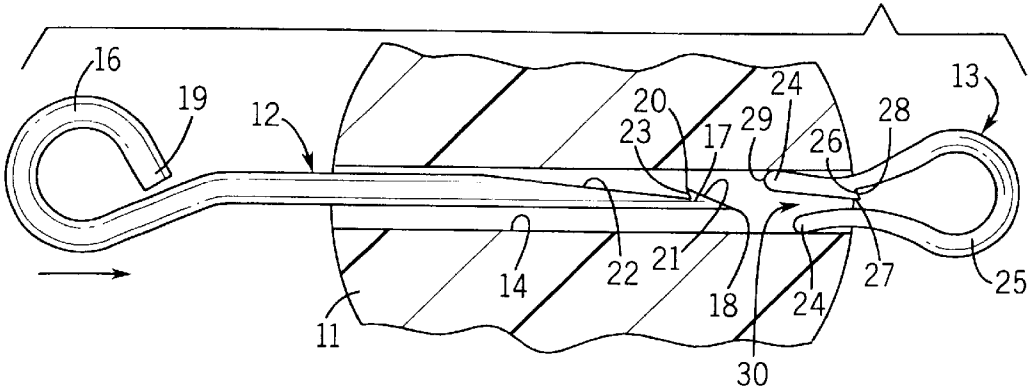
FIG. 5 is a view similar to FIG. 4 showing movement of the pin member toward the loop member prior to effecting the connection.

In FIG. 3, the cooperating loop member 13 is also formed from a metal strand which is formed by bending to define a pair of generally parallel legs 24 that are interconnected by an integral eyelet 25. On one of the legs 24, immediately adjacent the transition of the leg to the eyelet 25, a locking tooth 26 is formed. The tooth 26 has a laterally extending locking edge 27 which defines with the adjacent inside surface of the eyelet 25 a locking surface 28. As shown in FIGS. 5 and 6, the legs 24 on the loop member 13 are sized to allow them to be inserted into one end of the through bore 14 in a bead 11. Preferably, the legs are received in the bore with a loose contact fit as shown in FIG. 5. When positioned in the bore 14, the legs 24 of the loop member 13 define an attachment slot 30 therebetween. The legs are preferably tapered toward their ends 29 to provide a lead-in for the pin member 12. The pin member 12 is then inserted into the opposite end of the bore 14 until the lead edge 18 of the tooth 17 enters the slot 30 and, with the pin member 12 oriented such that the ramp surface 21 on the tooth 17 engages the inside of the loop member leg 24 on which the tooth 26 is formed, the tooth 17 on the pin member 12 will override the locking tooth 26 on the loop member 13, spreading the legs 24 apart slightly (FIG. 6) and locking the teeth together with their respective locking surfaces 23 and 28 in engagement (FIG. 4). The malleability and resilience of the preferred gold alloy material from which the members 12 and 13 are formed permits locking engagement of the members in a manner which secures the interlock in a surprisingly strong interengagement. Tensile loads applied to the connection along the axis of the through bore 14 result in uncurling of the eyelet 16 on the pin member 12 without breaking the engagement between the interengaging teeth 17 and 26. The connection between the pin member 12 and the loop member 13 may be enhanced by providing a slight curve in the legs 24 of the loop member 13 as shown in FIGS. 4, 5 and 7. The outer surfaces of the legs are slightly concave so that, when the legs of the loop member are inserted into the bore 14 in the bead, the ends 29 of the legs will bear against the surface of the bore. When the pin member 12 is inserted into the slot 30 between the legs 24, the legs will flatten slightly as they are deflected by passage of the tooth 17 on the pin member 12 (see FIG. 6). After the tooth 17 rides over the locking tooth 26 on the loop member 13, the legs may return somewhat to the FIG. 5 position.

As indicated above and with reference to FIG. 5, connection of the members 12 and 13 of the preferred embodiment requires that the members be properly oriented when inserted into the bore 14 so that the locking teeth 17 and 26 will properly engage. This requires not only that the members be oriented with their respective eyelets 16 and 25 lying generally in the same plane, but with the pin oriented rotationally so that the terminal end of the eyelet 16 is on the same side as the toothed leg 24 of the loop member 13. To alleviate somewhat the requirement of careful orientation, FIG. 8 shows an alternate embodiment in which a modified loop member 31 is provided with legs 32, each of which has a locking tooth 33. The pin member 12 is unchanged from the preferred embodiment. With the FIG. 8 embodiment, as long as the eyelet 16 of the pin member and the eyelet 34 of the modified loop member 13 are oriented in the same plane, rotational orientation of the members need not be a concern since the tooth 17 on the pin member will engage one or the other of the locking teeth 33 on the legs 32 of the modified loop member. The pin member 12 could also be modified to provide a pair of opposed teeth and used with the loop member 13 of the preferred embodiment, but it is believed that the reduced section at the end of the pin member shank formed with two teeth would result in a significant loss of strength in the interconnection of the members.

In the actual assembly of strand 10 of beads 11, and referring also to FIG. 4, prior to assembly of the pin member 12 to the loop member 13, the eyelet 25 of a second loop member 13 is connected to the eyelet 16 of the pin member 12. Similarly, the eyelet 16 of a second pin member 12 is connected to the eyelet 25 of the first loop member 13. Each of the final connections may also be strengthened by soldering the terminal end 19 of the eyelet 16 to the shank 15 of the pin member 12. It is contemplated that both the pin member 12 and the loop member 13 may be formed from a continuous metal strand using rolling or stamping techniques. Strands 10 of beads 11 which are formed utilizing the connector of the present invention may utilize the detachable connector disclosed in my co-pending U.S. application Ser. No. 09/592,318, filed on Jun. 13, 2000.

I claim:

1. A jewelry connector for a strand of beads in which each bead is provided with a circular cross section through bore for the connector, said connector comprising:

a loop member made from a first metal strand formed to define a pair of legs of semicircular cross section defining concave outer surfaces connected by a first eyelet, said legs defining therebetween an attachment slot and sized to fit in one end of the bore, one of said legs having a first tooth positioned in the slot; and, a pin member made from a second metal strand formed with a straight shank curled on one end to form a second eyelet, the shank sized to fit in the other end of the bore and having formed on the other end a second tooth adapted to override said first tooth in response to insertion of said other end of the shank into said attachment slot to press the concave outer surfaces against the surface of the bore and to lock the members together in the bore.

2. The jewelry connector as set forth in claim 1 wherein said first tooth is positioned on said one leg adjacent the first eyelet.

3. A jewelry connector for a strand of beads in which each bead is provided with a circular cross section through bore for serial connection, said connector comprising:

a loop member made from a metal strand having a pair of generally parallel legs of semicircular cross section defining concave outer surfaces connected by an integral eyelet, said legs sized to fit in one end of a through bore in a bead with and defining therebetween an attachment slot, one of said legs having a first tooth adjacent the connection to the eyelet, said first tooth extending toward the other leg and defining a laterally extending locking edge; and, a pin member made from a metal strand having a straight shank curled on one end to form an eyelet, the shank sized to fit loosely in the opposite end of the through bore and having formed on its opposite end a second tooth having a laterally extending locking edge adapted to override the locking edge of said first tooth in response to insertion of said opposite end of the shank into the slot to spread the legs of the loop member and press the concave outer surfaces against the surface of the bore in the bead and to lock the pin member and loop member together in the bore.

4. The jewelry connector as set forth in claim 3 wherein each of said first and second teeth has an outer tooth edge defining the edge of a locking surface.

* * * * *